US007538071B2

(12) United States Patent
Berger

(10) Patent No.: US 7,538,071 B2
(45) Date of Patent: May 26, 2009

(54) METHODS OF REDUCING THE NICOTINE CONTENT OF TOBACCO PLANTS AND TOBACCO PLANTS OBTAINED THEREBY

(76) Inventor: Carl Berger, 315A Shore Dr., Highlands, NJ (US) 07732

( * ) Notice: Subject to any disclaimer, the term of this patent is extended or adjusted under 35 U.S.C. 154(b) by 728 days.

(21) Appl. No.: 10/719,295

(22) Filed: Nov. 21, 2003

(65) Prior Publication Data

US 2005/0113256 A1 May 26, 2005

(51) Int. Cl.

| | |
|---|---|
| ***A01N 25/00*** | (2006.01) |
| ***A01N 37/00*** | (2006.01) |
| ***A01N 63/00*** | (2006.01) |
| ***A01N 65/00*** | (2006.01) |
| ***A24F 47/00*** | (2006.01) |
| ***A24B 15/00*** | (2006.01) |
| ***A24B 15/24*** | (2006.01) |
| ***A24B 15/30*** | (2006.01) |
| ***A61K 38/44*** | (2006.01) |

(52) U.S. Cl. ..... 504/189; 131/270; 131/290; 131/297; 131/310; 504/116.1; 504/117; 504/320; 504/335; 424/94.4

(58) Field of Classification Search ..... 504/116.1, 504/320, 335, 117, 189; 47/58.1 FV; 424/94.4
See application file for complete search history.

(56) References Cited

U.S. PATENT DOCUMENTS

| | | | | |
|---|---|---|---|---|
| 2,525,784 | A | | 10/1950 | Feinstein et al. |
| 2,525,785 | A | | 10/1950 | Feinstein et al. |
| 3,851,653 | A | * | 12/1974 | Rosen ..... 131/293 |
| 4,799,723 | A | | 1/1989 | Mahaffy |
| 5,158,099 | A | | 10/1992 | Rosen et al. |
| 5,713,376 | A | | 2/1998 | Berger |
| 6,008,436 | A | | 12/1999 | Conkling et al. |
| 6,054,318 | A | * | 4/2000 | Murray et al. ..... 435/418 |
| 6,303,326 | B1 | * | 10/2001 | Felton et al. ..... 435/14 |
| 6,423,520 | B1 | | 7/2002 | Conkling et al. |

OTHER PUBLICATIONS

Musser et al. "Caterpillar saliva beats plant defences". Nature. 416:599-600. Apr. 11, 2002.*

Naruhiro Hibi, Shinji Higashiguchi, Takashi Hashimoto, and Yasuyuki Yamada; The Plant Cell, 1994, 6, 723-735.*

* cited by examiner

*Primary Examiner*—John Pak
*Assistant Examiner*—Nathan W Schlientz
(74) *Attorney, Agent, or Firm*—Watov & Kipnes, P.C.

(57) ABSTRACT

The present invention is directed to a method of reducing the nicotine content of a tobacco plant to less than addictive levels. The method includes the step of administering to the tobacco plant an effective amount of a nicotine reducing agent sufficient to reduce the level of nicotine in the tobacco plant so that the resulting nicotine content in the plant is reduced to a level wherein a tobacco product produced from the plant will yield a non-addictive level of nicotine in the central nervous system blood plasma of the user. The present invention is further directed to tobacco plants prepared by the method.

8 Claims, No Drawings

METHODS OF REDUCING THE NICOTINE CONTENT OF TOBACCO PLANTS AND TOBACCO PLANTS OBTAINED THEREBY

FIELD OF THE INVENTION

The present invention is related generally to methods of reducing nicotine in tobacco plants, more particularly to methods of reducing the nicotine content of a tobacco plant in situ to levels where a tobacco product produced from the plant will yield a non-addictive level of nicotine in the blood plasma of the central nervous system of humans through the treatment of the tobacco plant especially the leaves with a nicotine reducing agent.

BACKGROUND OF THE INVENTION

Methods have been developed in the past to lower the content of nicotine in tobacco, given the concerns regarding the addictive nature of nicotine. Typically such methods involve chemically extracting nicotine from the tobacco prior to the usual processing required to make tobacco products. Frequently, these methods produce less satisfactory tobacco products since other ingredients in addition to nicotine are also removed from the tobacco. This adversely affects the desirable qualities of tobacco including good taste and flavor. Cultivating tobacco having reduced nicotine content has been of great interest to avoid the limitations of chemical extraction. Such methods have employed classical plant breeding and most importantly genetic modification techniques where the genetic composition of the tobacco plant is altered to produce plants that produce less nicotine. Although such methods have reduced nicotine in tobacco, they have not consistently produced cigarettes (Quest®—Nicotine Free) containing non-addictive levels of nicotine.

Nicotine is an active alkaloid compound produced primarily in the roots of tobacco plants (e.g., *Nicotiana tabacum* and *Nicotiana rustica*) and stored in the leaves and foliage. In humans, nicotine is typically ingested through the smoking or chewing of tobacco. Nicotine released from tobacco enters the body through the mucous membrane lining the mouth and lungs where it is readily absorbed into the bloodstream. The alkaloid compound has been observed to stimulate various parts of the central nervous system including the locus ceruleus and the mesolimbic center producing a feeling of well-being and enhanced mental alertness and activity in the user. After nicotine is cleared from the body, most users experience intense nicotine cravings that results in addiction to nicotine. The addictive effects of nicotine often frustrate many users who attempt to quit tobacco use.

Tobacco addiction can be prevented in most users by reducing the amount of nicotine in tobacco to levels, where during use, the blood plasma concentration of nicotine in the central nervous system is maintained below the threshold of 5 ng per ml, as disclosed in U.S. Pat. No. 5,713,376, the content of which is incorporated herein by reference. Tobacco products, which maintain the nicotine concentration in blood below this threshold level, do not produce nicotine addiction in most users. Such tobacco products typically contain nicotine at levels of about 0.01 mg per gram or less of dried tobacco.

Many unsuccessful attempts have been made to produce non-addictive tobacco while retaining many of the favorable characteristics in tobacco including good taste and flavor. For example, U.S. Pat. No. 5,158,099 teaches the use of a wetted impact barrier for reducing the content of tar and nicotine. U.S. Pat. No. 4,799,723 teaches the use of a filter consisting of a fibrous ion-exchange resin, which operates to remove ionic and carcinogenic constituents as well as nicotine and tar in tobacco smoke. U.S. Pat. No. 4,250,901 describes a chemical denaturant, to eliminate or trap nicotine and carbon monoxide. The prior art also teaches extracting nicotine from a raw tobacco product by steaming. For example, German Pat. No. 25,403 by Dr. Johannes Sartig teaches the use of superheated steam. In related techniques, U.S. Pat. Nos. 2,525,784 and 2,525,785 each teach the use of aluminum sulfate and ammonia-ethylene dichloride to separate nicotine from raw tobacco product.

There are several tobacco products, which are marketed and promoted as "nicotine-free", however such products have often been found to contain at least measurable amounts of nicotine, which are considered addictive levels of nicotine. For example, OMNI™ and QUEST 3™ cigarettes, each of which are marketed by Vector Tobacco Inc. of Miami, Fla. to be "nicotine-free" contains as much as 0.24 (low nicotine) mg/cigarette and 0.05 mg/cigarette (nicotine-free "trace"), respectively (each cigarette contains about 1 gram of dried tobacco). The amounts contained in such low nicotine or "nicotine-free" products are sufficiently high to elevate the nicotine concentration in blood plasma to levels where nicotine is addictive in humans.

Accordingly, in view of the prior art, it would be desirable to develop methods of reducing nicotine in tobacco plants in which the tobacco product produced from such plants with a nicotine reducing treatment contains nicotine below the levels that would cause nicotine addiction in humans, and result in an improved tobacco plant, retaining the highly desirable taste and flavor characteristics typically associated with standard untreated tobacco. It would be further desirable to develop methods of reducing nicotine in tobacco plants that are commercially practical and cost effective to implement.

SUMMARY OF THE INVENTION

In accordance with the present invention, it has been found that certain compounds when in contact with a tobacco plant can effectively counteract the production of nicotine to yield tobacco plants having a reduced nicotine content which can be used to produce a tobacco product that is non-addictive to humans. The present invention relates to improved tobacco plants and parts thereof (e.g. tobacco leaves) and methods of reducing nicotine in tobacco plants designed for human use and to tobacco products including cigarettes obtained thereby. More specifically, the improved tobacco plant of the present invention has been treated with a nicotine reducing agent in a manner that reduces the content of nicotine to levels where the tobacco product produced from the plant will yield a non-addictive level of nicotine in the blood plasma of the central nervous system of the user without adversely affecting taste and flavor of the tobacco. This is especially desirable for users of tobacco products who enjoy the flavor and taste of tobacco, but wish to avoid the addictive effects typically associated with conventional tobacco products.

In one aspect of the present invention, there is provided a method of reducing the nicotine content of a tobacco plant. The method comprises:

administering to the tobacco plant an effective amount of a nicotine reducing agent sufficient to affect the generation of nicotine in the tobacco plant so that the resulting nicotine content in the plant is reduced to a level wherein a tobacco product produced from the plant will yield a non-addictive level of nicotine in the blood plasma of the central nervous system of the user.

In another aspect of the present invention, there is provided a tobacco plant having a nicotine content wherein a tobacco product produced from the plant will yield a non-addictive level of nicotine in the blood plasma of the central nervous system of the user.

DETAILED DESCRIPTION OF THE INVENTION

In accordance with the present invention, there is provided a method of reducing the nicotine content of a tobacco plant to non-addictive levels and an improved tobacco plant prepared by the method. In the present invention, a tobacco plant especially tobacco leaves is generally treated with a nicotine reducing agent in amounts sufficient to inhibit nicotine synthesis, thereby reducing the nicotine content thereof to a level wherein a tobacco plant (e.g. tobacco leaf) will yield a non-addictive level of nicotine in the (CNS) central nervous system blood plasma of the user when used as part of a tobacco product. The methods of the present invention for reducing the nicotine content of tobacco plants provide an economical and simple approach to producing non-addictive tobacco products using otherwise conventional agricultural and tobacco processing techniques as known to those skilled in the art.

The present invention has applications to any suitable natural or modified plants including trees, shrubs, vines herbs and the like that are capable of generating natural defenses against natural antagonists. One such example is a tobacco plant which in its natural state produces a level of nicotine wherein a tobacco product produced from the plant will yield addictive levels of nicotine in the CNS blood plasma of the user. The present invention will adversely affect the production of nicotine in the plant thus yielding tobacco plants with such low levels of nicotine that tobacco products produced from the plants will have non-addictive levels of nicotine.

Nicotine is a toxic compound produced in tobacco plants as a defense mechanism to ward off herbivores. It has been recently observed that one species of herbivore can neutralize the nicotine defense mechanism in tobacco plants. *Helicoverpa zea* (*H. zea*), a herbivorous caterpillar, produces the enzyme glucose oxidase (GOX) in its salivary glands. During feeding on tobacco leaves, the caterpillar secretes saliva containing GOX onto the feeding area. The enzyme has been found to counteract the production of nicotine in the tobacco plant effectively neutralizing the plant defense mechanism and allowing the caterpillar to feed safely. Applicant has discovered that by instigating the above reactions in tobacco plants including tobacco plants in situ, a tobacco product produced from the plant will yield a non-addictive level of nicotine in the CNS blood plasma of the user.

The term "tobacco plant" as used herein means the entire plant as well as portions thereof suitable for making tobacco products, such as for example, tobacco leaves.

The term "in situ" as used herein means a tobacco plant which exists in its natural state (e.g. in an open field).

The term "nicotine reducing agent" means an agent that lowers the amount of nicotine in the treated area of the tobacco plant.

The terms "non-addictive level" or "non-addictive nicotine level" refer to the nicotine content in a tobacco plant wherein the amount of nicotine present is sufficiently low so that when the tobacco plant is subsequently processed into a tobacco product (e.g., cigarettes, cigars, pipe tobacco, chewing tobacco and the like), the resulting nicotine content of the tobacco product does not produce an addictive effect in humans when smoked or chewed.

It has been found that the key to effective elimination of nicotine addiction as a result of the use of tobacco is to reduce the nicotine in the tobacco plant to a level such that the resultant level of the nicotine in the user is substantially less than 25 ng per ml of CNS blood plasma, more preferably less than 5 ng per ml of CNS blood plasma. A critical feature of the present invention is the inhibition of the production of nicotine in the tobacco plant in a selective manner without appreciably affecting the other constituents in the tobacco plant. This feature of the invention substantially resolves the problems typically associated with prior art processes (e.g., steam extraction and chemical extraction such as aqueous aluminum sulfate and ammonia-ethylene dichloride) which require actual removal or extraction of nicotine from the tobacco plant ex situ or any surrounding matrix. Thus, it has been found that eliminating nicotine in a tobacco plant such as a tobacco leaf provides an effective and economical system for producing tobacco products which contain about 0.01 mg nicotine per cigarette or less (i.e., about 1 gram) while maintaining the other desirable ingredients for good taste and flavor. While the present invention is applicable to treating tobacco plants in situ, it will be understood that tobacco plants which have been uprooted or portions thereof (e.g. separated leaves) may be treated in a similar manner.

This exceedingly low level of nicotine contrasts favorably with genetically engineered processes disclosed, for example, in U.S. Pat. No. 6,008,436. However, such genetically engineered tobacco plants could be processed in accordance with the present invention so that tobacco leaf contains 0.01 mg nicotine per gram or less for processing into tobacco products such as cigarettes.

In accordance with the present invention, tobacco products produced from tobacco plants as described herein can be used for stimulative effects without the disadvantages of being exposed to addictive levels of nicotine. Thus, the reduction of nicotine generation in accordance with the present invention minimizes the problems and costs typically associated with nicotine addiction. Upon inhalation of tobacco smoke or other use of tobacco products produced from the tobacco plants treated according to the present invention, CNS blood levels of nicotine are maintained below 25 ng per milliliter, more preferably below 5 ng per milliliter and most preferably approaching 0 ng per milliliter.

In one embodiment of the present invention, there is provided a method of reducing the nicotine content of a tobacco plant in situ wherein the method comprises administering to the tobacco plant in situ an effective amount of a nicotine reducing agent sufficient to minimize the generation of nicotine in the tobacco plant so that the resulting nicotine content in the plant is reduced to a level wherein a tobacco product produced from the plant will yield a non-addictive level of nicotine in the CNS blood plasma of the user.

The term "nicotine reducing agent" as used herein includes active compounds which when administered to a tobacco plant reacts with nicotine in the tobacco plant lowering the nicotine content wherein a tobacco product produced from the plant will yield a non-addictive level of nicotine in the CNS blood plasma of the user. Preferably, the nicotine reducing agent is selected from glucose oxidase (GOX), gluconic acid, hydrogen peroxide and combinations thereof. More preferably, the nicotine suppressing agent is GOX.

The methods of the present invention include the preparation of compositions having properties conducive for reacting with and substantially lowering the nicotine content in tobacco plants, especially tobacco leaves. The compositions of the present invention may be administered to the tobacco plant through any suitable routes including, but not limited to, direct applications such as through spraying tobacco plants. The composition of the present invention comprises an effective amount of a nicotine reducing agent sufficient to lower the level of nicotine in a tobacco plant wherein a tobacco product produced from the plant will yield a non-addictive level of nicotine in the CNS blood plasma of the user.

Each of the nicotine reducing agents may be obtained from commercial sources, may be biochemical prepared (e.g. from organisms capable of producing a nicotine reducing agent) by methods known in the art and may also be isolated from natural sources including *Helicoverpa zea* and *Aspergillus niger* by methods known in the art.

The concentration of the nicotine reducing agent used and the amount of the compositions of the present invention will depend on various factors including, but not limited to, the type of tobacco plant, the quantity of tobacco plants to be treated, the mode of administration of the compositions, and the degree to which the nicotine content must be reduced in order to produce a tobacco product that yields a non-addictive level of nicotine in the CNS blood plasma of the user. The desired concentrations and amounts can be determined by one skilled in the art. The concentration of nicotine reducing agent can range from about 2 g. to 200 g. and preferably from about 20 g. to 100 g. per 55 gallon drum of the nicotine reducing composition containing the nicotine reducing agent as described below.

The compositions described herein may be combined with carriers known in the art. For example, the compositions may be combined with water, including tap water or distilled water, to which has been added selected minerals. The compositions may further be combined with an agricultural agent that may act as a carrier. For example, a fertilizer solution, pesticide solution, or herbicide solution may function as a carrier medium. The pesticide may be either a chemical or biological(natural) pesticide as known in the art, including fungicides, bacteriocides and anti-virals. One skilled in the art would be familiar with the various fertilizer, pesticide and herbicide solutions which may be employed. However, the nicotine reducing agents of the present invention may be most simply combined with water or dilute buffer. The additive materials mentioned above including 2 to 200 g. of the nicotine reducing agent may be dissolved in water or dilute buffer (0.1 M phosphate, pH =7) in a completely filled 55 gallon drum. The contents of 1-4 drums are typically sufficient for the treatment of one acre of tobacco plants. The treatment of tobacco plants which have been removed from the in situ environment (e.g. separated tobacco leaves may be treated in a similar manner).

The compositions may further include agricultural additives or formulation aids known to those skilled in the art. Such additives or aids may be used to ensure that the compositions disperse well in a spray tank, stick to or penetrate plant surfaces (particularly leaf surfaces) as well as provide other benefits to the plant. For example, tobacco plant acceptable surfactants, dispersants, humectants, and binders may be used to disperse the compounds or compositions described herein in a spray tank as well as to allow the compounds or compositions to adhere to and/or penetrate the plant surfaces.

The methods of the present invention include treating the plant especially the leaves with the compositions described above. The compositions of the present invention may be applied directly to the foliage of the plant. When the compositions are applied, as a spray, a hand sprayer may be used and the compositions may be sprayed to drip.

The methods of the present invention may be implemented as a single batch application or in multiple applications to the extent necessary to achieve a nicotine content of the tobacco plant at a reduced nicotine level. The frequency of the application of the composition to the tobacco plant in situ may vary, and can be determined by one skilled in the art. The period of such treatment may typically range from about one day to an entire growing season.

The method of the present invention may include damaging the tobacco plant being treated in situ prior to application of the present compositions. Such damage may be induced through abrasions, scrapes, punctures, and the like. It is believed that the resulting damage serves to simulate the feeding activity of the herbivore *H. zea* as it administers the nicotine reducing agent GOX into the tobacco plant, which enhances the reduction of nicotine in the tobacco plant.

In another embodiment of the present invention, the tobacco plants may be treated by directly contacting an organism preferably an herbivorous organism capable of damaging the tobacco leaves thereby eliciting the nicotine generation defense of the plant wherein GOX is administered by the *Helicoverpa zea* (*H. zea*) spinnerets to the tobacco plant in situ for a sufficient time to reduce the nicotine content to levels at which the tobacco product produced from the plant becomes non-addictive to humans. A preferred example of such an organism is *Helicoverpa zea*. It is noted that multiple applications of *H. zea* may be required to obtain the desired nicotine levels in the tobacco plants.

When the nicotine content is reduced to a desired reduced nicotine level, the herbivores may be separated from the tobacco plant through suitable means including vibrating or vigorous washing followed by treating the plants by conventional cleaning and processing into a final tobacco product. In a preferred embodiment of the invention the tobacco plant is a genetically engineered tobacco plant having an already reduced nicotine content (See U.S. Pat. No. 6,008,436). In this embodiment the desired nicotine levels in the tobacco plants in situ can be achieved with typically only 2-4 applications of the nicotine reducing agent.

The methods and compositions of the present invention are used to treat any suitable plant capable of producing and storing addictive levels of nicotine including, but not limited to tobacco plants, but are particularly useful for treating commercial tobacco plant crops including genetically engineered tobacco plants having an already reduced nicotine content when compared to non-genetically engineered tobacco plants. Examples of tobacco plants for use in the present methods include all species of *Nicotiana* such as, for example, *N. tabacum, N. rustica* and *N. glutinosa*. Any strain or variety of tobacco plants may be used. Preferred are strains that are already low in nicotine content especially those containing a nicotine level of less than 1 mg per gram tobacco.

In a preferred embodiment, the tobacco plant is a transgenic tobacco plant expressing substantially reduced nicotine content such as disclosed in U.S. Pat. Nos. 6,008,436 and 6,423,520, the content of each being incorporated herein by reference.

The tobacco plants of the present invention may be suitable for use in preparing any traditional tobacco product including, but not limited to cigarette tobacco, cigar tobacco, pipe tobacco, chewing tobacco and may be in any form including leaf tobacco, shredded tobacco or cut tobacco.

EXAMPLE 1

Experimental Tests Using *Helicoverpa zea*

Experimental tests are conducted using *H. zea* caterpillars on leaves of tobacco plants (*Nicotiana tabacum*). The leaves are fully expanded and equal in size. Each caterpillar possesses spinnerets which are the principal secretory structures of the labial salivary glands. The *H. zea* caterpillars are divided into two groups. In one group, the spinnerets are destroyed to prevent secretion of saliva. In the other group, the spinnerets are left intact. The caterpillars of both groups are each placed on a fully expanded leaf of a tobacco plant, respectively, and allowed to feed for about 3 days. The caterpillars are then removed and the leaves are individually ground. The ground leaves are then analyzed by liquid chromatography using aqueous extraction thereof with the alkaloids separated on a reverse phase column. Results of the analysis indicate a median nicotine reduction of about 26% in tobacco leaves fed by intact caterpillars as compared to the leaves fed by the caterpillars with destroyed spinnerets.

EXAMPLE 2

Experimental Tests on *Nicotiana tabacum*

Four groups of individual tobacco leaves are each treated with one of four test solutions containing glucose oxidase, raw salivary gland extract of *H. zea*, heat treated (inactive) glucose oxidase, or a water control. The leaves receiving the salivary gland extract are administered about 20 ng of glucose oxidase. The leaves were incubated for about 3 days. The results are shown in Table 1 below.

TABLE 1

Reduced Nicotine Production

| Method | Reduction of Nicotine (mg/g) |
|---|---|
| Water Control | 0.0 |
| Inactive GOX | 0.1 |
| Active GOX | 0.60-0.70 |
| Saliva with Active GOX | 0.70-0.80 |

As indicated in Table 1, leaves treated with glucose oxidase and salivary extract each exhibit significant reductions in nicotine over the control and the heat treated glucose oxidase in which glucose oxidase is rendered substantially inactive due to the application of heat. The leaves treated with active GOX show a nicotine reduction of about 0.60-0.70 mg/g, while the leaves treated with the salivary extract show a nicotine reduction of about 0.70-0.80 mg/g.

EXAMPLE 3

Pilot Scale Test of *Helicoverpa zea*-Induced Reduction of Nicotine in *N. tabacum*

Using the process and data obtained from Examples 1 and 2, mature tobacco plants (*N. tabacum*) are cultivated on a quarter acre plot. One group of the tobacco plants is exposed to *H. zea* neonates for a three day period during the growing season. A second group of the tobacco plants is exposed to *H. zea* neonates multiple times each for a three-day period during the growing season. A third group of tobacco plants is isolated from *H. zea* neonates for establishing a control. The leaves are harvested at the end of the growing season and the caterpillars are removed. The tobacco leaves are air dried and processed. Each of the dried tobacco leaves are treated and extracted with 10 ml of 25 mM sodium phosphate buffer at 30° C. for about 24 hours at constant agitation. The extract is then filtered and diluted prior to passage into a high performance liquid chromatograph using procedures outlined in Saunders et al. (1981) J. Chromatogr. 205, 147-154, the content of which is incorporated herein by reference. The results of the elution profile show that the first group exhibit reduced foliar nicotine levels of over 26% as compared to undamaged leaves of the control group. The second group of tobacco plants exposed to multiple treatments exhibit significantly greater reduction in foliar nicotine levels of from about 50% to 75% as compared to the undamaged leaves of the control group.

EXAMPLE 4

Experimental Tests using Genetically Modified Tobacco Plants

In a manner similar to Example 3, a half acre plot of suitable tobacco growing soil is divided into two plots [A and B]. Mature tobacco plants was cultivated as in Example 3 in one quarter acre plot (A) and yield foliar nicotine levels of 0.15-0.075 mg/gram of tobacco for use in cigarettes. The latter nicotine levels are equivalent to using the tobacco filler in Vector brand cigarettes Quest 1 (Low Nicotine) and Quest 2 (Extra low Nicotine) each of which is subjected to two (2) "caterpillar treatments".

In the other quarter acre plot (Plot B), tobacco leaves are grown by the process described in U.S. Pat. No. 6,008,436. The means for transforming plant tissue to yield low nicotine content tobacco plants can be performed by DNA mediated transformation by a bacteria containing Ti plasmid which transforms the susceptible plant cell capable of regeneration into the required plant. Another approach in producing a transgenic plant is to use microparticles for ballistic transformation to produce the transgenic tobacco plant.

The tobacco leaves produced in the transgenic plant are subjected to analysis as in Example 3 with a Quest "Nicotine Free" nicotine content of 0.05 mg per gram reported. With one 75% caterpillar *H. zea* reduction treatment or a GOX—leaf bruising treatment, the nicotine content is reduced to 0.01 mg of nicotine/per gram, the threshold for avoiding addiction by smoking. Depending on the efficiency of the transgenic operation and the nicotine content of the resultant dried tobacco two or more treatments may be required to attain the threshold nicotine requirement.

It should be recognized that when tobacco leaves contain a higher nicotine leaf content additional nicotine reducing treatments may be required. A tobacco leaf containing 0.3 mg nicotine/gram may require five nicotine reducing treatments to obtain 50% reductions of foliar nicotine levels with each treatment. A 75% reduction of nicotine per treatment would require three treatments. Any treatment to reduce nicotine content in tobacco would be subject to the latter constraints.

Twenty test subjects are divided into two groups and asked to smoke two packs of cigarettes per day each of A (0.15) and A (0.075) for a period of two weeks. Group A (0.15) has a group of 8 of 10 who indicate a desire to continue smoking when offered an opportunity to do so. Group A (0.075) has 6 of 10 individuals who desire to continue smoking.

Ten test subjects are asked to smoke two packs per day each of Quest 3 "Nicotine Free" cigarettes for two weeks. The tobacco in 20 cartons of Quest 3 is treated with a 75% "GOX" treatment and dried and reassembled into 20 cartons. Additionally, 20 cartons of transgenic tobacco is treated with a 75% "*H. Zea*" approach and ten other test subjects are asked to smoke two packs per day for two weeks. The "Quest 3"

group of ten has one individual who is reluctant to stop smoking. The "*H. zea*" test subjects has two individuals who continue to smoke.

EXAMPLE 5

Pilot Scale Test Utilizing Direct Application of Glucose Oxidase to Reduce Nicotine in *N. tabacum*

Glucose oxidase (GOX) extracted from *Aspergillus niger* is obtained from a commercial source Calzyme Laboratories, Inc. B443 Miguelito Court, San Luis Obispo, Calif. 93401. The molecular weight of GOX is measured to be about 160,000 comprising a flavin containing a glycoprotein. Solutions containing GOX and water are prepared in a ratio of 10 μl of water to 20 ng of GOX (90-95%). The GOX activity is measured at about 200 to 250 U/mg for GOX derived from *A. niger* in dry powder form. The value U is the amount of enzyme required to oxidize one micromole of glucose per minute at about 25° C. and pH=7.

Forty gallons of the solution based on the above ratio are prepared in a 55 gallon stainless steel drum. A spray device comparable to commercially available garden sprayers or oscillators are used to apply the solution on a quarter acre of genetically modified *N. tabacum* plants as described in U.S. Pat. No. 6,423,520. One day prior to the spray application, the leaves are slightly damaged with cutting tools. The leaves are harvested at the end of three to five days. The tobacco leaves are treated with a 75% "GOX" treatment and air dried and processed into cigarettes containing no fillers.

The cigarettes are smoked by 10 test subjects with restrictions similar to Example 5. In these tests only one subject expresses a desire to continue smoking.

EXAMPLE 6

We have discovered that generic defense mechanisms are elicited by herbivores such as caterpillars. In this example, a caterpillar (*Pieris brassicae*) attacks a cabbage plant releasing a defensive mixture of volatiles which attract parasitic wasps (*Cotesia glomerata*) which then attack and destroy the caterpillars. The caterpillar gut regurgitant contains enzymatic β-glucosidase which elicits the mixture of volatiles referred to above. Commercial β-glucosidase performs in a similar manner.

Cabbage (eight weeks old) and *P. Brassicae* (caterpillar) and parasitoids (wasps) are reared according to the method of Steinberg S. et al., Entomol. Exp. Appl 63 163-175 (1992). In the experiments the amount of β-glucosidase in 25 μl clearly results in the attraction of parasitoids (wasps). Ion chromatograms identifies (E)-2 hexanol, 1-hexanol, E-2-hexene 1-YL acetate as major components of the volatiles released by the cabbage plants. This experiment illustrates another specific example (compare to *H. zea*) of evolutionary arms race wherein an elicitor-antagonist biological system focuses on a defensive enzyme reaction.

The forgoing discussion discloses and describes merely exemplary embodiments of the present invention. One skilled in the art will readily recognize from such discussion, and from the accompanying claims, that various changes, modifications, and variations can be made therein without departing from the spirit and scope of the invention as defined in the following claims.

What is claimed is:

1. A method of reducing the nicotine content of a tobacco plant, said method comprising:

(a) damaging the tobacco plant being treated to simulate the feeding activity of the herbivore *Helicoverpa zea*; and (b) applying to the tobacco plant a composition selected from the group consisting of an aqueous solution of glucose oxidase and a salivary extract of a tobacco plant herbivore, wherein said composition contains 2 g to 200 g of glucose oxidase per 55 gallons to inhibit the synthesis of nicotine in the tobacco plant;

wherein steps (a) and (b) are repeated to sequentially lower the level of nicotine in the tobacco plant so that the resulting nicotine content in the tobacco plant treated with the composition (i) provides a non-addictive level of nicotine in the central nervous system blood plasma of the tobacco plant user and (ii) is less than or equal to 0.01 mg nicotine per 1 gram tobacco leaf.

2. The method of claim 1 comprising treating the tobacco plant in situ.

3. The method of claim 1 wherein the amount of the glucose oxidase is 20 to 100 grams per 55 gallons of the composition.

4. The method of claim 1 wherein the non-addictive level of nicotine is less than 25 ng/ml in central nervous system blood plasma.

5. The method of claim 1 wherein the non-addictive level of nicotine is less than 5 ng/ml in central nervous system blood plasma.

6. The method of claim 1 wherein the tobacco plant is selected from the group consisting of *Nicotiana tabacum, Nicotiana rustica* and *Nicotiana glutinosa.*

7. The method of claim 1 wherein the tobacco plant is a genetically modified plant, exhibiting a reduced level of nicotine as compared to non-genetically modified tobacco plants.

8. The method of claim 1 comprising applying the glucose oxidase directly to an exterior of a portion of the tobacco plant.

* * * * *